US005966942A

United States Patent [19]

Mitchell

[11] Patent Number: 5,966,942

[45] Date of Patent: Oct. 19, 1999

[54] PULSE TUBE REFRIGERATOR

[76] Inventor: Matthew P. Mitchell, 151 Alvarado Rd., Berkeley, Calif. 94705

[21] Appl. No.: 08/963,366

[22] Filed: Nov. 3, 1997

Related U.S. Application Data

[60] Provisional application No. 60/030,086, Nov. 5, 1996.

[51] Int. Cl.[6] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 3,198,214 | 8/1965 | Lorenz | 138/37 |
| 3,219,048 | 11/1965 | Palmisano | 137/81.5 |
| 3,431,746 | 3/1969 | Webster | 62/86 |
| 4,131,134 | 12/1978 | Lindberg | 137/808 |
| 4,286,627 | 9/1981 | Graf | 137/810 |
| 4,830,053 | 5/1989 | Shaw | 137/808 |
| 4,993,487 | 2/1991 | Niggerman | 165/164 |
| 5,269,147 | 12/1993 | Ishizaki | 62/6 |
| 5,295,355 | 3/1994 | Zhou et al. | 62/6 |
| 5,412,952 | 5/1995 | Ohtani et al. | 62/6 |
| 5,481,878 | 1/1996 | Shaowei | 62/6 |
| 5,720,172 | 2/1998 | Ishizaki et al. | 62/6 |

OTHER PUBLICATIONS

G. Thummes, F. Giebeler, C. Heiden, Effect of Pressure Wave Form on Pulse Tube Refrigerator Performance, p. 383, Cryocoolers 8, (R.G. Ross, Jr., ed.), Plenum Press, 1995.

Matsurbara, et al. "Alternative Methods of the Orifice Pulse Tube Refrigerator", pp. 127–135, Proc. Internat'l Cryocooler Conf., Aug. 1988, Monterey, California.

Ishizaki, et al. "Experimental Performance of Modified Pulse Tube Refrigerator Below 80K Down to 23K", pp. 140–146, Proc. 7th Internat'l Cryocooler Conf., Nov. 1992, Santa Fe, New Mexico.

Samdani, et al. "Heat Exchange: The Next Wave", pp. 30–37, Chemical Engineering, Jun. 1993.

Kakimi, et al. "Pulse–Tube Refrigerator and Nitrogen Liquefier with Active Buffer System", pp. 247–253, Cryocoolers 9, Proc. 9th International Cryocooler Conference, Sep. 1996 New Hampshire.

Hagiwara, et al. Experimental Study on the Pulse Tube Refrigerator with Two Relief Valves, pp. 279–284 Cryocoolers 9, Proc. 9th International Cryocooler Conference, Sep. 1996 New Hampshire.

*Primary Examiner*—Ronald Capossela
*Attorney, Agent, or Firm*—Douglas E. White

[57] ABSTRACT

Fluidic devices, including constant-rotation double diodes and constant-rotation double vortex tubes, are disclosed with which to construct pulse tube refrigerators having diode loops, constant-rotation double diodes, constant-rotation double vortex tubes, and asymmetrical diode stacks. Present orifice pulse tube refrigerators use an orifice connected at the warm end of the pulse tube to a reservoir. The orifice and reservoir serve to control flows at the warm end of the pulse tube so that they are not in phase with flows at the cold end. Present heat exchangers at the warm end suffer inefficiencies due to heat-regenerative effects caused by return flows through the orifice. The fluidic devices disclosed herein create dynamic replacement orifices for pulse tube refrigerators that also serve as efficient heat exchangers and supercoolers with minimal regenerative characteristics.

24 Claims, 6 Drawing Sheets

PULSE TUBE REFRIGERATOR

CROSS REFERENCE TO RELATED APPLICATIONS

This application claims the benefit of U.S. Provisional Application No. 60/030,086, filed Nov. 5, 1996.

GOVERNMENT RIGHTS

The invention was made with Government support under contract F29601-96-C-0097 awarded by the United States Air Force. The Government has certain rights in the invention.

BACKGROUND—FIELD OF INVENTION

This invention relates to pulse tube refrigerators, including pulse tube cryocoolers, more particularly to pulse tube refrigerators having fluidic devices that dynamically resist flow while simultaneously extracting heat.

BACKGROUND—DESCRIPTION OF PRIOR ART

Pulse tube refrigerators are a variation on a class of regenerative refrigerators that includes Stirling cycle and Gifford-McMahon refrigerators. Stirling and Gifford-McMahon refrigerators use displacers to move a fluid (usually helium) through their regenerators and reject heat through a single heat exchanger location. Distinguishing characteristics of the pulse tube refrigerator are that it has no mechanical displacer; that the pulse tube itself is a nearly adiabatic space in which the temperature of the working fluid is stratified; and that it rejects heat through two separate warm heat exchangers (hereinafter referred to as the warm heat exchanger and the aftercooler).

Pulse tube refrigerators operate by compressing and expanding fluid in conjunction with fluid movement through heat exchangers. In the prior art orifice pulse tube refrigerator shown in FIG. 1, an orifice connects the warm end of the pulse tube to a reservoir, allowing some fluid to flow from the pulse tube through a warm heat exchanger into the reservoir when pressure in the pulse tube is higher than the pressure in the reservoir, and to return by the same route when pressure in the pulse tube falls below pressure in the reservoir. Reservoir mean pressure is typically similar to mean pressure in the pulse tube.

The orifice and reservoir serve to control flows at the warm end of the pulse tube so that they are not in phase with flows at the cold end. That is, the flow at the warm end from the pulse tube toward the reservoir occurs at all times when pressure in the pulse tube is higher than pressure in the reservoir. Thus, flow from pulse tube to reservoir continues even after flow into the cold end of the pulse tube has ceased and outflow has begun.

Similarly, when pressure in the reservoir is higher than the pressure in the pulse tube, fluid flows from the reservoir to the pulse tube. That is true not only when fluid is leaving the cold end of the pulse tube and pressure in the pulse tube is falling but also during the first part of the subsequent inflow of fluid at the cold end of the pulse tube until pressure in the pulse tube equals and exceeds the pressure in the reservoir.

Over the cycle in an orifice pulse tube, the flows, in sequence, are as follows:

1. Inflows to the pulse tube at both ends;
2. Continued inflow at the cold end; outflow at the warm end;

3. Outflow at the cold end; continued outflow at the warm end; and
4. Continued outflow at the cold end; inflow at the warm end (after which the cycle repeats).

The effect of the orifice is thus to control phasing of fluid flows in the pulse tube relative to pulse tube pressures, alternately forcing warm, compressed fluid through the warm heat exchanger and expanded, cold fluid through the cold heat exchanger.

Performance of the orifice pulse tube can be improved by connecting the compressor to the warm end of the pulse tube with a bypass as shown in FIG. 2. The bypass transfers some fluid from the compressor directly to the pulse tube, thereby decreasing the amount of fluid that emerges from the cold end of the regenerator into the pulse tube during the part of the cycle in which fluid is being compressed and thereby warmed adiabatically. Similarly, the bypass removes warm fluid from the pulse tube during the portion of the cycle during which fluid is leaving the pulse tube at the cold end. That permits cold fluid to linger longer in the cold end of the pulse tube while it is being cooled adiabatically.

The purpose and effect of an orifice is the same whether or not a bypass is used. The standard prior art orifice used to control flow between pulse tube and reservoir is a small hole or a narrow tube through which the fluid must pass. In laboratory work, the orifice is typically a needle valve that permits the aperture of the orifice to be adjusted, but adjustable valves are not satisfactory for commercial products that must operate unattended. An orifice fashioned by drilling a hole or by installing a capillary tube must be designed and built to very fine tolerances, which is difficult and expensive.

A standard method of removing heat from the warm end of a pulse tube refrigerator is through a stack of copper screens that are packed into the warm end of the pulse tube and brazed to the pulse tube wall. Heat transferred from the working fluid travels along the wires of the screens and into the pulse tube wall, where it is removed. That arrangement is not optimal, particularly in large pulse tubes. Heat has a long distance to travel through the narrow conduction paths of wires to get from the center of the heat exchanger to the pulse tube wall. Moreover, fluid returning to the pulse tube from the reservoir is cooling adiabatically as pressure falls, and its temperature may momentarily fall below the temperature of the warm heat exchanger, causing the screens to function as regenerators, releasing heat back to the fluid. This regenerative effect is unwanted and degrades performance. In any event, heat exchangers of this type require painstaking care in their construction.

Warm heat exchangers made of stacked screens serve a second purpose, which is to straighten and distribute flow into the pulse tube. However, that function is not essential; diffusers also distribute flow, but without the objectionable regenerative characteristics of screens.

SUMMARY OF THE INVENTION

This invention improves upon both the orifice and the warm heat exchanger of orifice pulse tubes and double-inlet pulse tubes by combining their function in fluidic devices that dynamically resist flow while simultaneously extracting heat in an efficient manner from the fluid flowing through them. By eliminating screen-type warm heat exchangers, this invention greatly reduces losses due to regenerative effects in the orifice flow. In effect, this invention uses the work that is otherwise dissipated in the orifice of a pulse tube refrigerator to dynamically enhance heat rejection. Key components of this invention are fluidic devices that combine flow resistance with high capacity for heat transfer. These devices can be easily made to relatively loose tolerances. These devices can be diodes that are directional, so that they provide effects similar to check valves, but with no moving parts. By arranging diodes to force circulation through a loop, regenerative effects can be reduced and fluid returned to the pulse tube can be cooler than it would be in a prior art orifice pulse tube refrigerator, thereby improving performance of the pulse tube refrigerator.

This invention benefits pulse tube refrigerators that employ a pressure wave that varies significantly from sinusoidal. The performance of an orifice pulse tube cryocooler (low temperature refrigerator) can be improved by altering the timing of the pressure wave that compresses and expands the fluid in the pulse tube, allowing a disproportionate amount of time for flow through the warm heat exchanger after the fluid in the pulse tube has been compressed. See G. Thummes, F. Giebeler, C. Heiden, "Effect of Pressure Wave Form on Pulse Tube Refrigerator Performance", Cryocoolers 8, (R. G. Ross, Jr., ed.), Plenum Press 1995, p. 383. However, altering the pressure wave also alters flows through the orifice to the reservoir. A long period of dwell at high pressure increases mean pressure in the reservoir relative to mean pressure in the pulse tube, resulting in non-optimal flow phasing. By employing the fluidic diodes of this invention to make flow from pulse tube to reservoir more difficult than the return flow from reservoir to pulse tube, the adverse effect of high pressure dwell on phasing can be counteracted.

OBJECTS AND ADVANTAGES

Several objects and advantages of this invention are:

(a) To provide a single component that replaces both the orifice and the warm heat exchanger of an orifice pulse tube refrigerator.

(b) To provide a single component that replaces both the orifice and the warm heat exchanger of an orifice pulse tube refrigerator and that causes the refrigerator to operate more efficiently.

(c) To provide a single component that replaces both the orifice and the warm heat exchanger of an orifice pulse tube refrigerator and that causes the refrigerator to reach a lower temperature.

(d) To provide a single component that replaces both the orifice and the warm heat exchanger of an orifice pulse tube refrigerator and that causes the refrigerator to achieve more refrigeration at a specified temperature.

(e) To provide a pumped loop that improves heat rejection at the warm end of an orifice pulse tube refrigerator by reducing regenerative effects of the warm heat exchanger and that causes the refrigerator to operate more efficiently.

(f) To provide a pumped loop that improves heat rejection at the warm end of an orifice pulse tube refrigerator by reducing regenerative effects of the warm heat exchanger and that causes the refrigerator to reach a lower temperature.

(g) To provide a pumped loop that improves heat rejection at the warm end of an orifice pulse tube refrigerator by reducing regenerative effects of the warm heat exchanger and that causes the refrigerator to achieve more refrigeration at a specified temperature.

(h) To provide a less expensive alternative to prior art orifices and warm heat exchangers.

(i) To provide a more rugged and reliable alternative to prior art orifices and warm heat exchangers.

(j) To provide compensation for time of flow in a pulse tube refrigerator employing a pressure wave with high pressure dwell in order to maintain mean reservoir pressure at the level of mean pulse tube pressure.

Other novel features which are characteristic of the invention, as to organization and method of operation, together with farther objects and advantages thereof will be better understood from the following description considered in connection with the accompanying drawing, in which preferred embodiments of the invention are illustrated by way of example. It is to be expressly understood, however, that the drawing is for illustration and description only and is not intended as a definition of the limits of the invention.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF DRAWINGS

Drawing Figures

REFERENCE NUMERALS IN DRAWINGS

Figure 1:
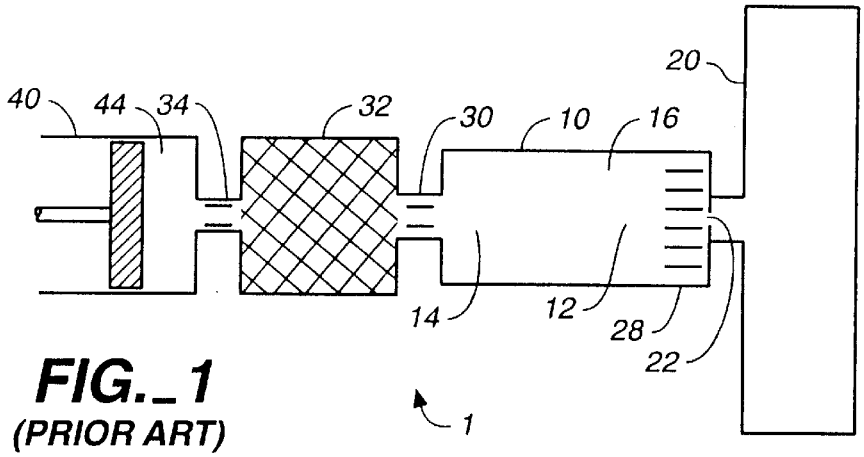
FIG. 1 (PRIOR ART)
FIG. 1 is a schematic view of a prior art orifice-type pulse tube refrigerator.

1-1*a* orifice pulse tube refrigerator
10 pulse tube
12 warm fluid
14 cold fluid
16 plug of stratified fluid
20 reservoir
22 orifice
24 bypass tube
26 bypass orifice
28 warm heat exchanger
30 cold heat exchanger
32 regenerator
34 aftercooler
40 piston-type compressor/expander
44 compression/expansion space
60 vortex diode
62 race
64–64*c* tangential passage
66 axial hole
70 vortex tube refrigerator
72–72*c* vortex chamber
74 hot exhaust port
76–76*b* cold exhaust vent
78*b*-78*c* vortex generator
79*b*-79*c* annular manifold
82*b*-82*c* main duct
164 tangential passage
168 constant-rotation double diode
172 vortex chamber
264 tangential passage
269 constant-rotation reversible flow vortex tube
272 vortex chamber
276 cold exhaust vent
282 main duct
284 cold return duct
364 tangential passage
369 constant-rotation reversible flow vortex tube
372 vortex chamber
376 cold exhaust vent
382 main duct
384 cold return duct
390 venturi
464 tangential passage
472 vortex chamber
474 hot exhaust port
476 cold exhaust vent
480 constant-rotation double vortex tube
482 main duct
484 cold return duct
560 vortex diode
564 tangential passage
566 axial hole
572 vortex chamber
574 hot exhaust port
576 cold exhaust vent
580 constant-rotation double vortex tube
582 main duct
584 cold return duct
664 tangential passage
672 vortex chamber
674 hot exhaust port
676 cold exhaust vent
680 constant-rotation double vortex tube
682 main duct
684 cold return duct
690 venturi
701 pulse tube refrigerator
710 pulse tube
718 diffuser
720 reservoir
728 warm heat exchanger
730 cold heat exchanger
732 regenerator
734 aftercooler
740 piston-type compressor/expander
744 compression/expansion space
752 duct
760-760*a* vortex diode
764-764*a* tangential passage
786 diffuser tee
787 reservoir tee
788 loop
801 pulse tube refrigerator
810 pulse tube
818 diffuser
820 reservoir
830 cold heat exchanger
832 regenerator
834 aftercooler
840 piston-type compressor/expander
864-864*a* tangential passage
868 constant-rotation double diode
872 vortex chamber
901 pulse tube refrigerator
910 pulse tube
918 diffuser
920 reservoir
930 cold heat exchanger
932 regenerator
934 aftercooler
940 piston-type compressor/expander
964-964*a* tangential passage
972 vortex chamber
976-976*a* cold exhaust vent
980 constant-rotation double vortex tube
984-984*a* cold return duct
1001 pulse tube refrigerator
1010 pulse tube
1018 diffuser
1020 reservoir
1030 cold heat exchanger
1032 regenerator
1034 aftercooler
1050 compressor
1054 high pressure accumulator
1056 low pressure accumulator
1058 valve
1060 vortex diode It is to be noted that, for convenience, the last two positions of the reference numerals of alternative embodiments of the invention duplicate those of the numerals of the embodiment of FIG. 1, where reference is made to similar or corresponding parts. However, it should not be concluded merely from this numbering convention that similarly numbered parts are equivalents.

DETAILED DESCRIPTION OF THE INVENTION

A prior art orifice pulse tube refrigerator 1 is illustrated schematically in FIG. 1. A piston-type compressor/expander 40 having a compression/expansion space 44 sends an oscillating pressure wave through aftercooler 34, regenerator 32, and cold heat exchanger 30 into a pulse tube 10. The pulse tube 10 communicates with a reservoir 20 through an orifice 22 in its warm end, which may be a hole, a capillary tube or an adjustable valve. Warm fluid 12, typically helium, passes through a warm heat exchanger 28 as it flows back and forth through the orifice 22 between the pulse tube 10 and the reservoir 20. The orifice 22 controls the amount of flow to and from the reservoir 20. At the other end of the pulse tube 10, cold fluid 14 passes back and forth between pulse tube 10 and regenerator 32 through a cold heat exchanger 30. Warm fluid 12 and cold fluid 14 are separated by a plug of stratified fluid 16 that oscillates back and forth in the pulse tube 10 but never leaves it. That plug of stratified fluid 16 contains a strong temperature gradient.

Figure 2:
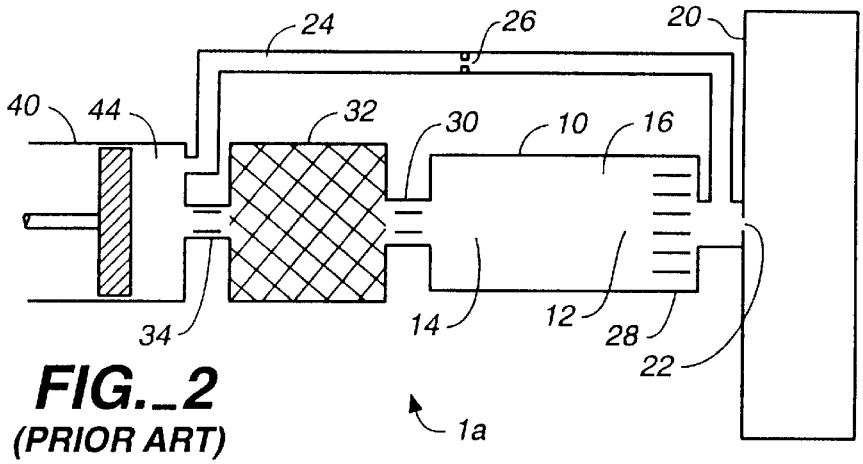
FIG. 2 (PRIOR ART)
FIG. 2 is a schematic view of a prior art orifice-type pulse tube refrigerator with a secondary inlet bypass.

FIG. 2 is a schematic illustration of a prior art orifice pulse tube refrigerator 1*a* with bypass 24 (sometimes called a "double-inlet pulse tube refrigerator"). It is similar to the prior art orifice pulse tube refrigerator 1 illustrated in FIG. 1 except that the compression/expansion space 44 of the piston-type compressor/expander 40 communicates with the warm end of the pulse tube 10 through a bypass tube 24 containing a bypass orifice 26, which may be a hole, capillary tube, or adjustable valve that limits flow through the bypass tube 24.

Figure 3:
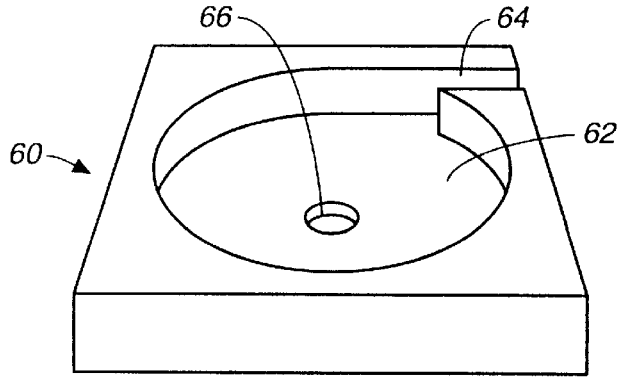
FIG. 3 (PRIOR ART)
FIG. 3 is a schematic perspective view of a prior art vortex diode.

FIG. 3 is a schematic perspective illustration of a prior art fluidic vortex diode 60 with its cover removed. The race 62 of the diode is a disk-shaped chamber. The chamber or race 62 has two openings: the axial hole 66 and the tangential passage 64. The tangential passage comprises means for injecting fluid tangentially into the vortex race or chamber (as do other tangential passages discussed below). Fluid can flow through the diode from one opening to the other in either direction, but the vortex diode 60 offers more resistance to flow that enters the race 62 from the tangential passage 64 and exits through the axial hole 66 than to flow that passes through the diode in the opposite direction. More elaborate diodes with multiple tangential passages and carefully sculpted tangential passages and axial holes are equivalent. Other fluidic diodes that resist flow in one direction more strongly than flow in the opposite direction are also equivalent.

Figure 4A:
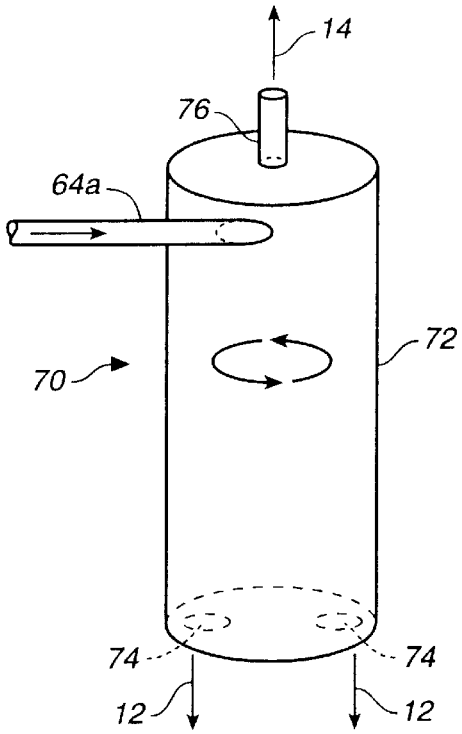
FIG. 4A (PRIOR ART)
FIG. 4A is a schematic perspective view of a prior art vortex tube.

FIG. 4A is a schematic, perspective illustration of a prior art vortex tube refrigerator 70, also known as a Ranque vortex tube, a Hilsch tube or a Ranque-Hilsch tube. A vortex chamber 72 has three openings: a tangential passage 64*a*, one or more hot exhaust ports 74 and a cold exhaust vent 76. In operation, fluid enters the vortex chamber 72 through the tangential passage 64*a* and exits in two streams. Inside the vortex chamber 72, the fluid that enters through the tangential passage rotates rapidly. The outer portion of the rotating fluid spirals down toward the hot exhaust ports 74, where a stream of warm fluid 12 exits. An inner core of rotating fluid moves from the end of the vortex chamber 72 that is adjacent to the hot exhaust ports 74 upward toward the opposite end of the vortex chamber 72, where a stream of cold fluid 14 exits through the cold exhaust vent 76.

Figure 4B:
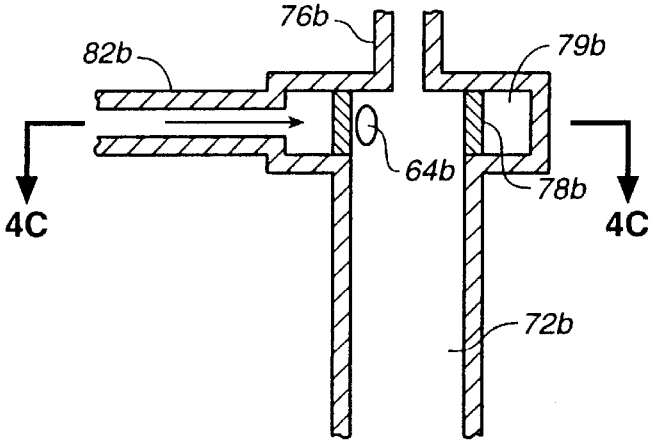
FIG. 4B (PRIOR ART)
FIG. 4B is a broken cross sectional representation of a prior art vortex tube equipped with prior art vortex generator.
Figure 4C:
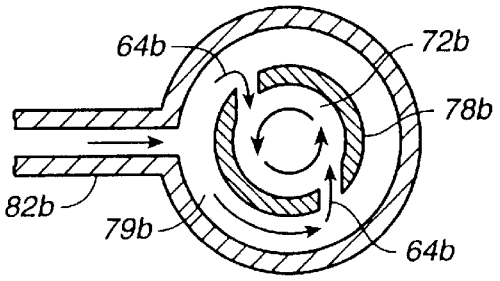
FIG. 4C (PRIOR ART)
FIG. 4C is a an orthogonal cross section of the prior art vortex tube and vortex generator of FIG. 4B, taken along line 4C—4C of FIG. 4B.

FIGS. 4B and 4C illustrate an alternative and equivalent prior art method of introducing fluid into a vortex chamber 72*b*. Fluid is introduced through a main duct 82*b* into an annular manifold 79*b* from which it passes through multiple tangential passages 64*b* drilled through a vortex generator ring 78*b* that is concentric with and which forms the end of the vortex chamber 72*b*. A stream of cold fluid exits through the cold exhaust vent 76*b*.

Figure 4D:
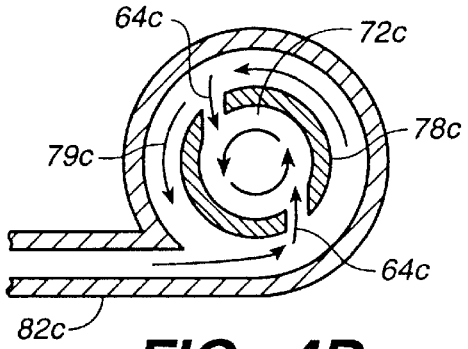
FIG. 4D (PRIOR ART)
FIG. 4D is a cross section of a prior art vortex tube equipped with prior art vortex generator with a tangential entrance to annular manifold.

FIG. 4D illustrates an alternative method of arranging the main duct 82*c* of a prior art annular manifold 79*c*, which otherwise is similar in construction to the manifolds of FIGS. 4B and 4C. The entrance to the annular manifold 79*c* from the main duct 82*c* is tangential. As before, fluid reaches the vortex chamber 72*c* through tangential passages 64*c* in the vortex generator 78*c*.

Figure 5:
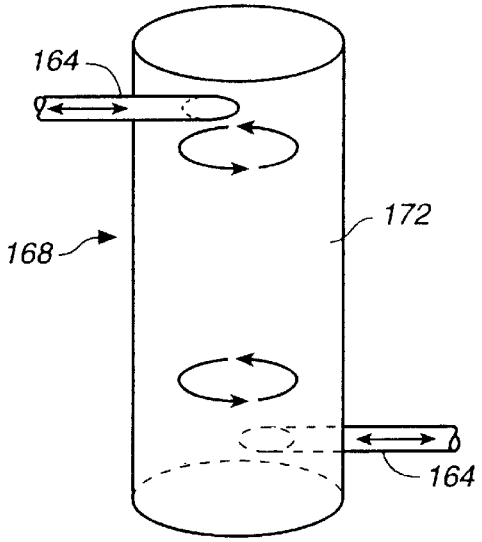
FIG. 5 is a schematic perspective view of a constant-rotation double diode of the present invention.

FIG. 5 is a schematic, perspective illustration of a novel constant-rotation double diode 168 of this invention. The constant-rotation double diode comprises a vortex chamber 172 into which two tangential passages 164 feed fluid alternately from each end. The tangential passages 164 are oriented so that they cause the fluid in the vortex chamber 172 to rotate the same direction regardless of which of the two tangential passages is feeding fluid into the vortex chamber 172. When fluid is entering the vortex chamber 172 through a tangential passage 164 at one end, it is exiting the vortex chamber 172 through the other tangential passage 164 at the other end. In the process of exiting, the rotating fluid must make a sharp reversal in direction, which creates a large pressure drop between the fluid in the vortex chamber 172 and the exiting fluid in the tangential passage 164 through which it exits. A constant-rotation double diode 168 thus acts as a flow impedance or dynamic orifice, resisting flow through it. A constant-rotation double diode also acts as a high capacity heat exchanger by forcing convection between the swirling fluid and the walls of the vortex chamber 172. Thus, warm fluid entering from a pulse tube is rapidly cooled as it spirals through the vortex chamber 172. Heat is removed from the exterior wall of the vortex chamber 172 by known means such as a water jacket (not shown).

Figure 6:
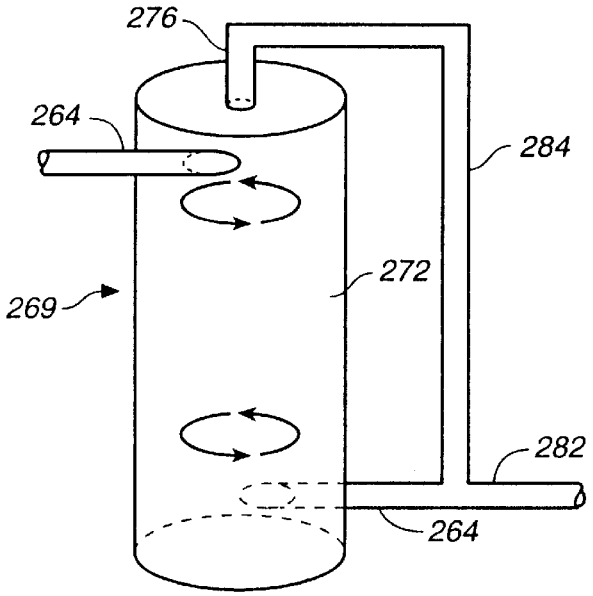
FIG. 6 is a schematic perspective view of a constant-rotation, reversible flow vortex tube of the present invention.

FIG. 6 is a schematic perspective view of a novel constant-rotation reversible flow vortex tube 269. It is similar to the constant-rotation double diode 168 of FIG. 5 in that tangential passages 264 at each end are oriented to force fluid in the vortex chamber 272 to rotate in the same direction without regard to which tangential passage 264 the fluid enters the vortex chamber 272 through. The constant-rotation reversible flow vortex tube 269 differs from the constant-rotation double diode 168 shown in FIG. 5 in that it has a cold exhaust vent 276 at one end and a cold return duct 284 that connects to the tangential passage 264 at the junction of the tangential passage 264 and main duct 282 at the opposite end of the vortex chamber 272.

Figure 7:
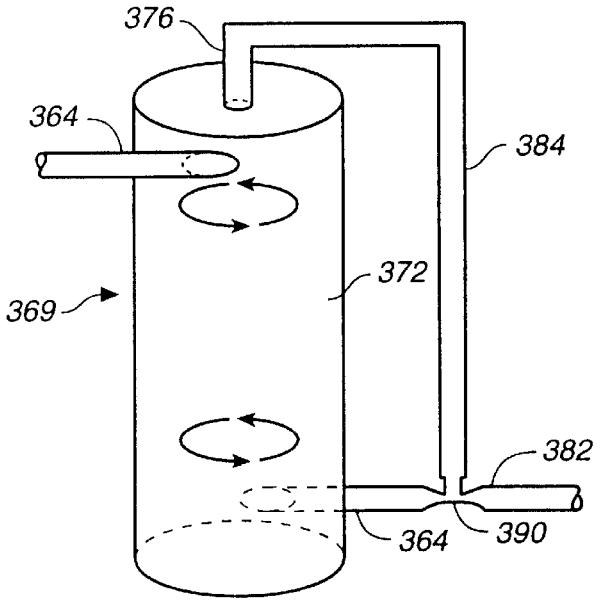
FIG. 7 is a schematic perspective view of a constant-rotation, reversible flow vortex tube of the present invention equipped with a venturi at the intersection of the cold return duct and main duct.

FIG. 7 is a schematic perspective view of another novel constant-rotation reversible flow vortex tube 369, which is of the general type shown in FIG. 6 except that the cold exhaust vent 376 and the cold return duct 384 leading from the vortex chamber 372 are connected to the tangential passage 364 at the junction of that passage and main duct 382 through the suction side of a venturi 390.

Figure 8:
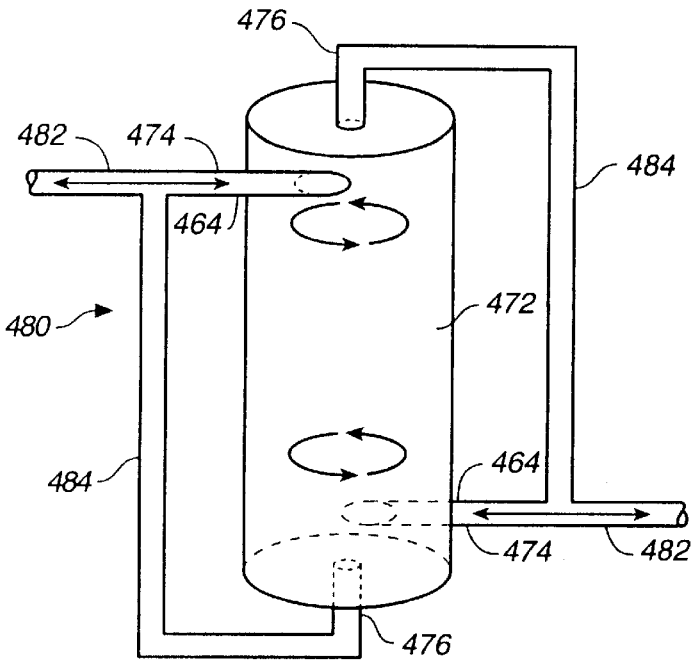
FIG. 8 is a schematic perspective view of a constant-rotation double vortex tube of the present invention.

FIG. 8 is a schematic illustration of a novel constant-rotation double vortex tube 480 of this invention. A constant-rotation double vortex tube 480 is a double-ended version of a constant-rotation reversible flow vortex tube 269, 369 as shown in FIGS. 6 and 7. In the vortex chamber 472 of the constant-rotation double vortex tube 480, there are two tangential passages 464, one at each end of the vortex chamber 472. The two tangential passages 464 are oriented so that fluid in the vortex chamber 472 will always be driven to rotate in the same direction regardless of which tangential passage 464 fluid enters through. In each instance, fluid entering from a main duct 482 passes through a tangential passage 464 that becomes a hot exhaust port 474 when flow is going the other direction. Fluid that enters the vortex chamber 472 through a tangential passage 464 forces some fluid to leave the vortex chamber, hot, through the hot exhaust port 474 at the opposite end of the vortex chamber 472. The entering fluid also forces fluid to leave the vortex chamber 472, cold, through the cold exhaust vent 476 and its associated cold return duct 484 adjacent to the tangential passage 464 through which fluid is entering the vortex chamber 472.

Figure 9:
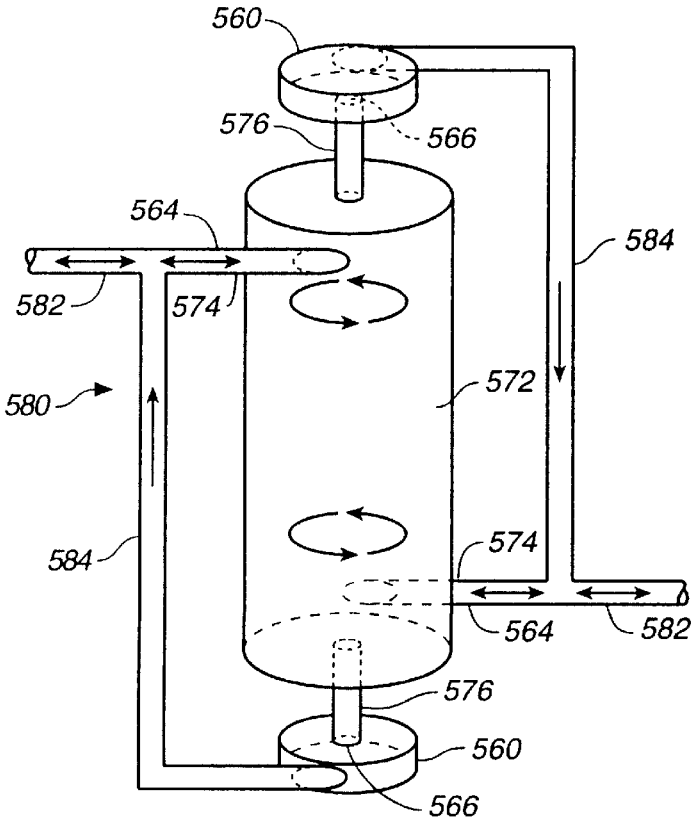
FIG. 9 is a schematic perspective view of a constant-rotation double vortex tube of the present invention equipped with vortex diodes in the cold passages.
Figure 10:
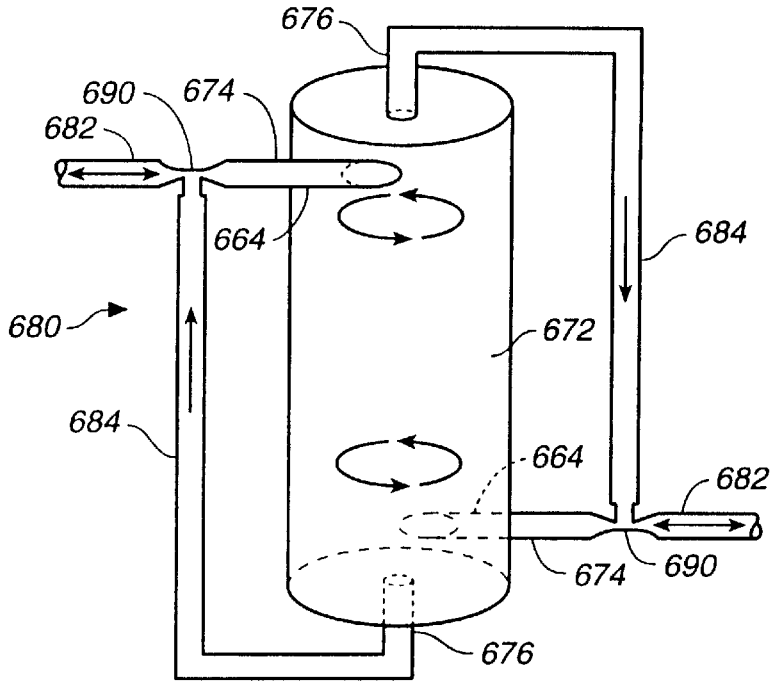
FIG. 10 is a schematic perspective view of a constant-rotation double vortex tube of the present invention equipped with venturis at the intersections of the cold return ducts and the main ducts.

FIG. 9 and FIG. 10 are schematic perspective views of methods of ensuring that most of the fluid approaching the constant-rotation double vortex tube 580, 680 through a main duct 582, 682 will enter the vortex chamber 572, 672 through a tangential passage 564, 664 (on fluid exit, alternately referred to as the hot exhaust port 574, 674, respectively) rather than by back-flow through a cold return duct 584, 684 and cold vent 576, 676. As shown in FIG. 9, each cold exhaust vent 576 leads to the axial hole 566 of a vortex diode 560. In FIG. 9, each of the vortex diodes 560 is connected to the main duct 582 at the opposite end of the vortex chamber 572 through a cold return duct 584. In FIG. 10, the vortex diodes 560 are replaced by venturis 690 that are placed at the junctions of main ducts 682, tangential passages 664 and cold return ducts 684 at both ends of the vortex chamber 672.

Figure 11:
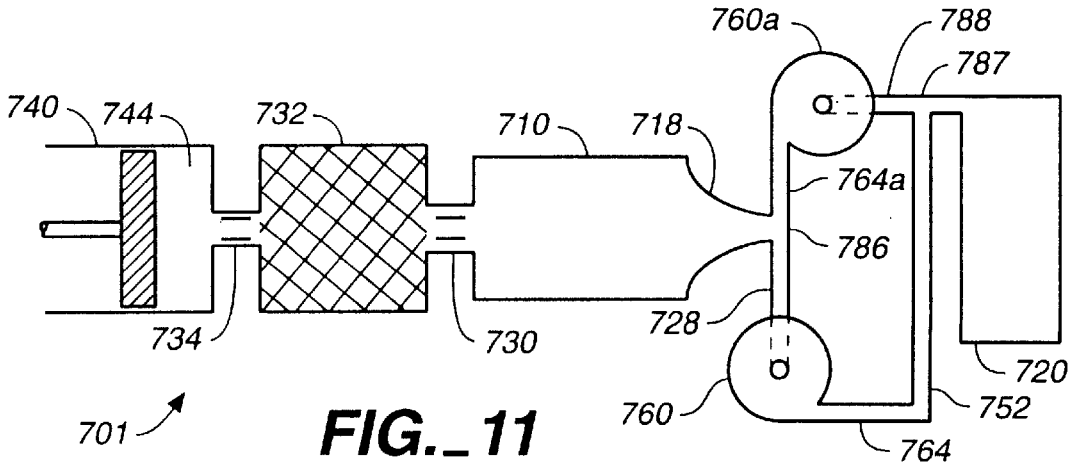
FIG. 11 is a schematic view of an embodiment of a pulse tube refrigerator of the present invention with a diode loop and a directly-connected reciprocating compressor.

FIG. 11 is a schematic illustration of a new improved pulse tube refrigerator 701 of this invention. A piston-type compressor 740, having compression/expansion space 744, is connected through an aftercooler 734 to a regenerator 732, which is connected to a cold heat exchanger 730 connected to a pulse tube 710. The latter tube is connected to a diffuser 718 connected to a tee 786, to which is attached a loop 788 of other components. Attached to one side (the lower side in FIG. 11) of the diffuser tee 786 is a first vortex diode 760 oriented to allow freer flow from the pulse tube 710 by way of tangential passage 764 to the reservoir 720 than in the opposite direction. Attached to the other (upper) side of the diffuser tee 786 by another tangential passage 764*a* is a second vortex diode 760*a* oriented to allow freer flow from the reservoir 720 to the pulse tube 710 than in the opposite direction. The two vortex diodes 760, 760*a* are connected to each other with a duct 752 in which a reservoir tee 787 branches off to the reservoir 720. A warm heat exchanger 728 may optionally be included between the diffuser 718 and the lower vortex diode 760 that is oriented to favor flow from the pulse tube 710 toward the reservoir 720.

Figure 12:
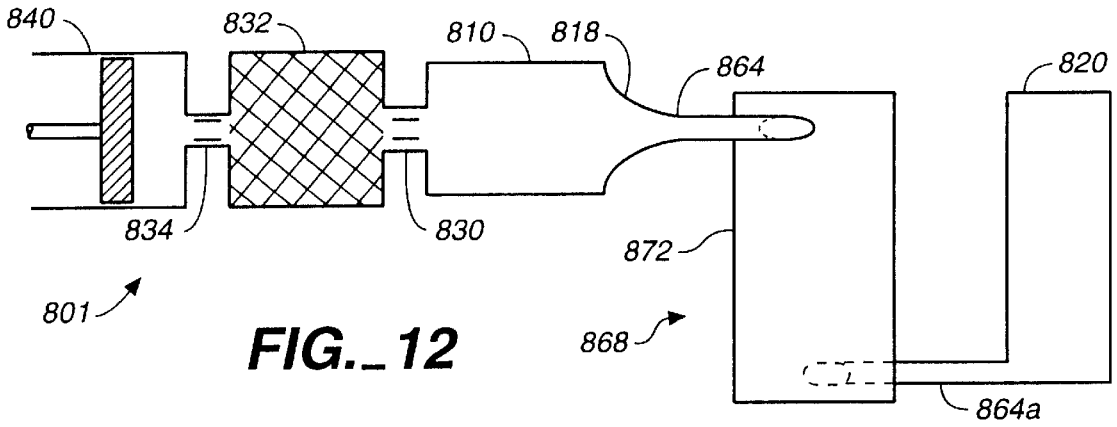
FIG. 12 is a schematic view of an alternate embodiment of a pulse tube refrigerator of the present invention with a constant-rotation double diode and a directly-connected reciprocating compressor.

FIG. 12 is a schematic illustration of a novel pulse tube refrigerator 801 of this invention. A piston-type compressor 840 is connected through an aftercooler 834 to a regenerator 832. The regenerator is connected to a cold heat exchanger 830 connected to a pulse tube 810, which is, in turn, connected to a diffuser 818 connected by a first tangential passage 864. The latter passage leads to a constant-rotation double diode 868 having a vortex chamber 872. The vortex chamber is connected by a second tangential passage 864*a* to a reservoir 820.

Figure 13:
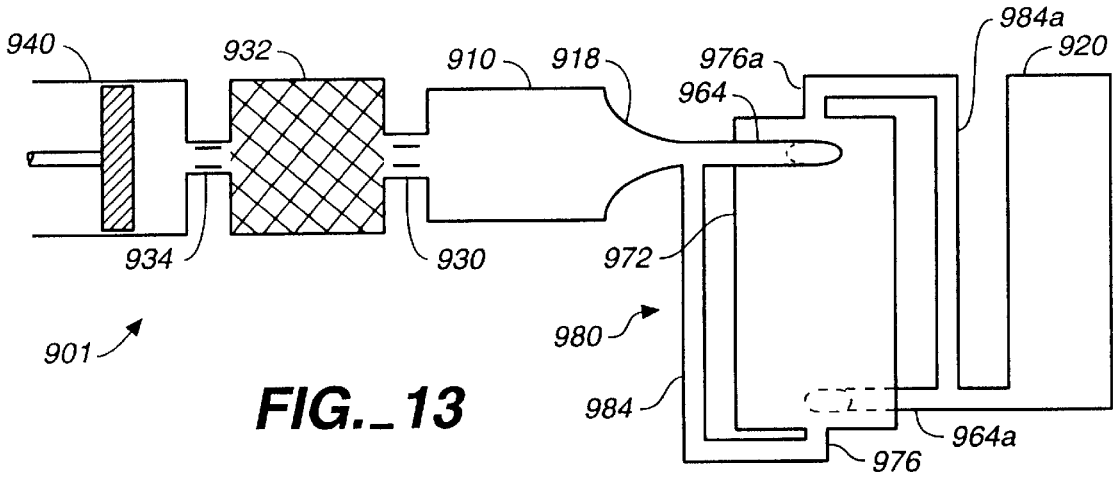
FIG. 13 is a schematic view of another alternate embodiment of a pulse tube refrigerator of the present invention with a constant-rotation double vortex tube and a directly-connected reciprocating compressor.

FIG. 13 is a schematic illustration of another new pulse tube refrigerator 901 of this invention. A piston-type compressor 940 is connected through an aftercooler 934 to a regenerator 932 connected to a cold heat exchanger 930. The cold heat exchanger 930 is connected to a pulse tube 910 connected to a diffuser 918, which is connected to a constant-rotation double vortex tube 980 connected to a reservoir 920. The diffuser 918 leads to a first tangential passage 964 attached near the upper, or first, end of a vortex chamber 972. Branching off of the first tangential passage is a first cold return duct 984, which leads to a lower cold exhaust vent 976, which, in turn, leads into the axial center of the lower, or second, end of the vortex chamber 972. Due to its location on the second end of the vortex chamber, the lower cold exhaust vent 976 will be referred to as the "second" such vent. A first (upper) cold exhaust vent 976*a* leads to a second cold return duct 984*a*, which duct meets a second tangential passage 964*a* connected to the reservoir 920.

FIGS. 4A, 5, 6, 7, 8, 9, 10, 12 and 13 are schematic, and each greatly exaggerates the diameter of the respective vortex chamber relative to its length. The ratio of length to diameter in vortex chambers of effective devices may be of the order of 20 to 1 or greater.

Figure 14:
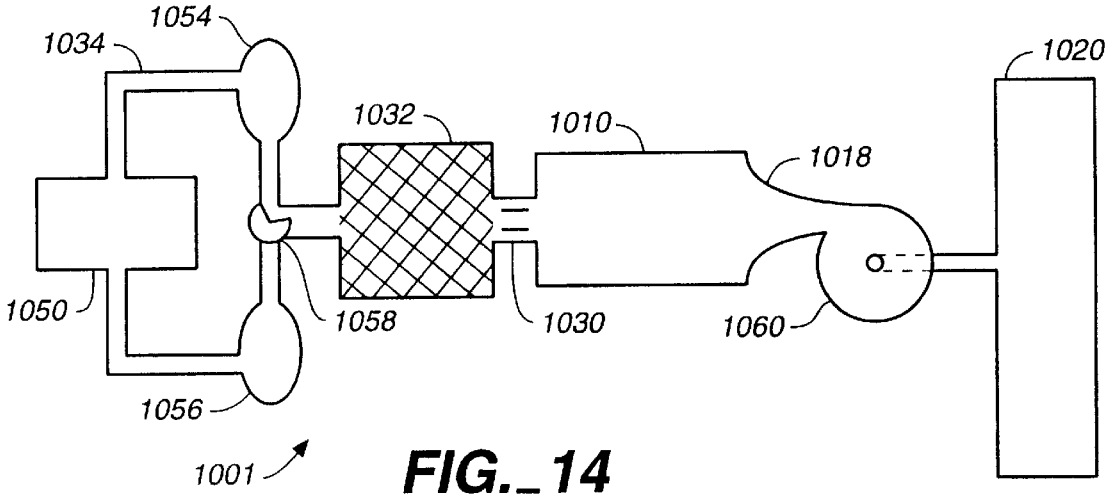
FIG. 14 is a schematic view of another alternate embodiment of a pulse tube refrigerator of the present invention with a compressor, accumulators, valves and a fluidic diode.

FIG. 14 is a schematic illustration of another new pulse tube refrigerator 1001 of this invention. A compressor 1050 is connected to a high pressure accumulator 1054 through an aftercooler 1034 and to a low pressure accumulator 1056. The high pressure accumulator 1054 and the low pressure accumulator 1056 are connected to a valve 1058 that can alternately connect the high pressure accumulator 1054 and the low pressure accumulator 1056 to a regenerator 1032 connected to a cold heat exchanger 1030. This exchanger is connected to a pulse tube 1010, connected to a diffuser 1018, connected to a vortex diode 1060, which is connected, in turn, to a reservoir 1020.

Operation—FIGS. 1 to 14

The cooling capacity of a pulse tube refrigerator is expressed in terms of the amount of heat that can be absorbed at the cold heat exchanger. The amount of heat that can be absorbed is directly determined by the amount of heat that is rejected at the warm end of the pulse tube. Effective heat rejection at the warm end is thus a key to good pulse tube performance.

To achieve good heat rejection at the warm end of the pulse tube, the flow of fluid through the orifice must be in proper phase relative to flows into and out of the pulse tube at its cold end. The orifice 22 of an orifice pulse tube refrigerator 1 as shown in FIG. 1 has the primary purpose of adjusting phasing of the flow at the warm end of the pulse tube 10. The bypass 24 of the double-inlet pulse tube refrigerator 1*a* as shown in FIG. 2 further adjusts phasing by altering the flow and thus the phasing at the cold end of the pulse tube 10.

As noted as background above, the warm heat exchangers of prior art orifice pulse tube refrigerators are commonly stacks of copper screens braised to the pulse tube walls. The wires of the screens do double duty, conducting heat to the pulse tube's walls and acting as flow-straighteners to insure that a uniform front of fluid emerges from the heat exchanger and enters the pulse tube. Although useful as flow distributors, stacked screens are not essential for that purpose. A well-designed diffuser can move fluid into and out of the end of a pulse tube with little loss due to turbulent mixing. Screens have the disadvantage of acting, in part, as regenerators and re-heating fluid that returns to the pulse tube 10 from the reservoir 20 of prior art pulse tube refrigerators shown in FIGS. 1 and 2. Diffusers 718, 818, 918, and 1018 (FIGS. 11–14) have far less regenerative effect.

This invention improves upon both the orifice and the warm heat exchanger of orifice pulse tubes and double-inlet pulse tubes by combining their function in fluidic devices that dynamically resist flow while simultaneously extracting heat from the fluid flowing through them. By eliminating screen-type warm heat exchangers, this invention greatly reduces losses due to regenerative effects in the orifice flow. In effect, this invention uses the work that is otherwise dissipated in the orifice of a pulse tube refrigerator to dynamically enhance heat rejection. Key components of this invention are fluidic devices that combine flow resistance with high capacity for heat transfer.

The prior art vortex diode 60 as shown in FIG. 3 resists flow in one direction more strongly than in the other. That is because, when fluid enters the race 62 from the tangential passage 64, it is forced into a continuous turn as it proceeds around the race. Inertia of the fluid tends to hold the fluid on the outer circumference of the race 62, resisting its movement toward the axial hole 66 where the fluid eventually exits. When flow moves in the opposite direction, however, it enters the race 62 through the axial hole 66 and passes more or less straight and unimpeded out through the tangential passage 64.

The "diodicity" of a vortex diode can be expressed in terms of the relative flow in each direction for a given pressure difference between the entrance and exit points. For a given geometry and pressure difference, diodicity is determined primarily by the specific gravity of the fluid and its viscosity; high specific gravity and low viscosity produce the highest diodicity. Helium, the preferred fluid in cryocoolers, has a very low specific gravity, even when highly compressed. Although its viscosity is likewise low, limited diodicity is attainable with helium in the pressure and pressure-drop regime in which pulse tube refrigerators operate. However, diodicity ratios in the range of 2:1 are readily obtainable with helium in pulse tube applications, and those ratios are sufficient for the purposes of this invention.

The prior art vortex tube refrigerator 70 shown in FIG. 4A, like the prior art vortex diode 60 shown in FIG. 3, injects fluid tangent to the wall of a circular chamber, creating a rapidly-rotating vortex. The vortex tube differs from the vortex diode in using a long vortex chamber 72 in place of a squat race 62 and in having two exits: one or more hot exhaust ports 74, each of which is at the periphery of the vortex chamber 72 and the cold exhaust vent 76, which is axial to the vortex chamber 72 and of smaller diameter. A tangential passage 64*a* enters the vortex chamber near the cold end and the vortex flow proceeds down the vortex chamber to the warm end where a portion of the flow 12 exits through the hot exhaust ports 74 and the remainder returns in the center of the vortex chamber, exiting as a cold stream 14 through a cold exhaust vent 76. By adjusting the flow at the hot exhaust ports 74, it is possible to control both the flow and the temperature of the fluid passing through the cold exhaust vent 76 in ways known in the vortex tube art.

This invention takes advantage of a vortex tube's capacity to separate a flow of fluid into two streams, one hotter than the incoming stream and the other colder. Since the hot fluid is in the outer layers of the vortex, it readily transfers heat to the walls of the vortex chamber 72 (or 72*b*, 72*c*), where that heat can be removed. When the hot and cold streams are recombined, the net energy in the fluid has been reduced and the temperature of the recombined fluid lowered relative to the temperature of a stream that had simply passed through an orifice. The fluid can be supercooled. That is, it can be cooled even though the stream entering through the tangential passage 64*a* is cooler than the wall of the vortex chamber 72 so long as the warm outer layer of fluid in the vortex chamber 72 is warmer than the wall of the vortex chamber 72.

FIG. 4A shows fluid entering a vortex chamber 72 through a single tangential passage 64*a*. A more effective method of creating a vortex in the vortex chamber is to introduce fluid into the vortex chamber 72*b* through several tangential passages fed from an annular manifold 79*b* as shown in the prior art arrangement illustrated in FIGS. 4B and 4C. That arrangement can be further improved as shown in FIG. 4D by introducing fluid tangentially into the annular manifold through an offset main duct 82*c*.

As shown in FIG. 4A, the prior art vortex tube refrigerator 70 is a one-way device; a flow continually enters the tangential passage 64, maintaining a continuous vortex in the vortex chamber 72. The arrangement shown in FIG. 4A is not appropriate for reversing flow; the vortex would be disturbed if flow were to periodically reverse, entering the vortex chamber 72 at the hot exhaust ports 74 and the cold exhaust vent 76 while exiting the vortex chamber 72 at the tangential passage 64.

The constant-rotation double diode 168 shown in FIG. 5 maintains constant-rotation of fluid in a vortex chamber 172 despite reversing flow by orienting tangential passages 164 at both ends so that they force rotation in the same direction regardless of which tangential passage fluid enters the vortex chamber 172 through. Although a constant-rotation double diode 168 does not separate a stream of cold fluid from a stream of warm fluid, it does act as a simple, effective impedance and heat exchanger.

The constant-rotation reversible-flow vortex tube 269 shown in FIG. 6 also maintains constant-rotation of fluid in a vortex chamber 272 as in the constant-rotation double diode 168 illustrated in FIG. 5. However, a constant-rotation reversible-flow vortex tube 269 also separates the flow in one direction into two streams, one hot and one cold. When flow enters the vortex chamber through the tangential passage 264 adjacent to the cold exhaust vent 276, the cold stream through cold return duct 284 combines with a warm stream emerging from vortex chamber 272 through tangential passage 264 at the opposite end as the streams enter main duct 282.

The venturi 390 shown in FIG. 7 serves as means for facilitating fluid flow out of the cold exhaust vent 376 through a cold return duct 384 toward the venturi 390 regardless of which direction fluid is flowing in the tangential passages 364.

The constant-rotation double vortex tube 480 shown in FIG. 8 acts as a vortex tube with flows in both directions. Tangential passages 464 connect with the vortex chamber 472 at both ends, oriented so that flow through each tangential passage 464 forces rotation in the same direction. In both directions of flow in the main ducts 482, a cold stream is tapped off from the center of the vortex and combined with a warm stream in main duct 482, downstream from the vortex chamber 472.

In the embodiment of the constant-rotation double vortex tube 580 shown in FIG. 9, cold exhaust 576 at each end of the vortex chamber 572 is connected to a vortex diode 560, arranged so that fluid flows easily from the vortex chamber 572 through the vortex diode 560 to a cold return duct 584, but only enters vortex chamber 572 through a cold exhaust vent 576 with difficulty. Like the venturi 390 of the device of FIG. 7, the vortex diodes 560 comprise means for facilitating fluid flow out the cold exhaust vents 576 through cold return ducts 584 toward the main ducts 582 regardless of which direction fluid is flowing in the tangential passages 564.

In the embodiment shown in FIG. 10, fluid enters the constant-rotation double vortex tube 680 alternately through each of the main ducts 682, and exits from the other. The entering flow goes into the vortex chamber 672 through a tangential passage 664 rather than through a cold exhaust vent 676 because a venturi 690, comprising another form of fluid flow direction-facilitating means, at the confluence of the main duct 682, tangential passage 664 and cold return duct 684 constantly draws fluid through the cold return duct 684 toward the venturi 690 regardless of the direction of flow in the main ducts 682. When flows in the main ducts 682 reverse, all of the flows in the various passages and ducts of the constant-rotation vortex tube 680 also reverse, excepting only the direction of rotation of flow inside the vortex chamber 672, and the flows in the cold return ducts 684, which remain the same.

In each direction of flow in a constant-rotation double vortex tube 480, 580, 680, the separation of an outer layer of hot fluid from a core of cold fluid rotating inside the respective vortex chamber permits heat to be transferred from fluid to the inner wall of the vortex chamber and rejected from the outer wall of the vortex chamber to a suitable heat sink. The rapidly-rotating vortices in both vortex diodes and vortex tubes generate forced convection that makes these devices extremely efficient heat exchangers.

In addition to its fiction as a heat exchanger, a constant-rotation double vortex tube 480, 580, 680 illustrated in FIGS. 8, 9 and 10, respectively, offers substantial resistance to fluid flow between one main duct 482, 582, 682 and the other. By proper sizing of the constant-rotation double vortex tube, it can be made to provide an optimal degree of flow restriction between a pulse tube and an associated reservoir. It can thus serve the function of both orifice and warm heat exchanger, performing the combined functions more efficiently than they are performed by separate components in prior art pulse tube refrigerators.

FIG. 11 illustrates a method of incorporating vortex diodes into a pulse tube refrigerator to serve both as heat exchangers and as a flow impedance that replaces an orifice. Two vortex diodes 760, 760*a* are incorporated in a loop 788 connected to a diffuser 718 at the warm end of a pulse tube 710. One vortex diode 760 is oriented to favor flow away from the pulse tube 710, and the other vortex diode 760*a* is oriented to favor flow back to the pulse tube 710. The loop 788 is connected through a tee 787 to a reservoir 720, which could also be made integral with loop 788. Optionally, a warm heat exchanger 728 (not shown) may be placed between the diffuser and the vortex diode that favors flow away from the pulse tube 710. In operation, both vortex diodes 760, 760*a* resist flow in both directions, but their diodicity pumps some fluid around the loop 788, permitting the vortex diode that receives the major flow from the pulse tube 710 to trap some hot fluid in the loop, where its heat can be rejected. As a result, the diode that favors flow returning to the pulse tube 710 remains cooler, and regenerative effects are minimized. Although the diode arrangement is shown in FIG. 11 in conjunction with a piston-type compressor 740 it can also be used with other types of compressors.

FIG. 12 illustrates a preferred embodiment of the invention using the constant-rotation double diode 168 as shown in FIG. 5. A constant-rotation double diode 868 of appropriate flow resistance is interposed between a diffuser 818 and reservoir 820 of a pulse tube refrigerator 801, simultaneously serving the functions of both an orifice and a warm heat exchanger. Note that fluid is tangentially injected into the vortex chamber 872 through the tangential passage 864 when fluid is flowing from the pulse tube 810 to the reservoir 820. Fluid also is tangentially injected into the vortex chamber 872 when fluid is flowing from the reservoir 820 to the pulse tube 810—in this case through the tangential passage 864*a*. Other applications of fluidic devices to pulse tube refrigerators could involve injecting fluid tangentially into the vortex chamber only in one direction of overall flow or the other.

FIG. 13 illustrates a preferred embodiment of the invention using a constant-rotation double vortex tube 480 as shown in FIG. 8. A constant-rotation double vortex tube 980 designed for appropriate flow resistance is interposed between the diffuser 918 and reservoir 920 of an orifice pulse tube refrigerator 901, simultaneously serving the functions of both an orifice and a warm heat exchanger. In the orifice pulse tube refrigerator 901, constant-rotation double vortex tubes 580, 680 as shown in FIGS. 9 and 10 may also be substituted for the version shown in FIG. 8 and FIG. 13.

FIG. 14 illustrates a preferred embodiment of the invention using a vortex diode 1060 in conjunction with a compressor 1050 with high pressure accumulator 1054, low pressure accumulator 1056 and valve 1058. With this arrangement, it is possible to create an asymmetrical pressure wave in the pulse tube that results in a long flow of hot, high pressure fluid from pulse tube 1010 to reservoir 1020 and a short return flow of lower pressure fluid from reservoir 1020 to pulse tube 1010 by methods known to the art. If an ordinary orifice is used between the pulse tube 1010 and reservoir 1020, the effect is to pump up pressure in the reservoir 1020 during the long period of inflow. The short period of outflow does not return pressure in the reservoir 1020 to its original level, and the mean pressure in the reservoir 1020 remains higher than the mean pressure in the pulse tube 1010, which adversely affects phasing of flows. By substituting a vortex diode 1060 for the orifice, flow from pulse tube 1010 to reservoir 1020 may be more strongly resisted than flow from reservoir 1020 back to pulse tube 1010. In that way, the mean pressure in the reservoir 1020 may be equalized with the mean pressure in the pulse tube 1010 and optimal phasing may be maintained. Again in this configuration, the vortex diode 1060 may serve the function of both orifice and arm heat exchanger.

Vortex diodes behave much like electrical resistors; they may be arranged either in series or in parallel. In all cases where a vortex diode is called for, multiple diodes may be used. To increase flow resistance, diodes may be stacked in series with the axial hole of the first diode connected to the tangential passage of the next, and so on. To decrease flow resistance, vortex diodes may be arranged in parallel by connecting the tangential passages of several diodes to the same fluid source and the axial holes of each to the same outlet.

Ramifications and Scope

The advantages of the pulse tube refrigerator itself are well known. The present invention improves the thermodynamic performance of orifice pulse tube refrigerators, including double-inlet pulse tube refrigerators, by improving direct heat transfer at the warm end of the pulse tube and reducing regenerative heat transfer in the warm heat exchanger. This invention also improves the performance of pulse tube refrigerators with pressure waves that dwell at high pressure by maintaining the optimal relationship between mean pressure in the pulse tube and mean pressure in the reservoir.

The above disclosure is sufficient to enable one of ordinary skill in the art to practice the invention, and provides the best mode of practicing the invention presently contemplated by the inventor. Although the description above contains many specificities, these should not be construed as limiting the scope of the invention but merely as providing illustrations of some of the presently preferred embodiments of this invention. For example, although some of the drawings show a piston-type compressor/expander as the compressor, any other type of compressor or compressor and valve arrangement that can generate a pressure wave is equivalent, including thermal acoustic devices known to the pulse tube refrigerator art. Although many of the drawings show as a tangential passage a tube that intersects the wall of a vortex chamber, vortex generators such as are illustrated in FIGS. 4B, 4C and 4D are equivalent. Other types of fluidic diodes are equivalent to vortex diodes Tesla's diode, considered to be the first true fluidic device, described in U.S. Pat. No. 1,329,559 is an example.

Thus, the scope of the invention should be determined by the appended claims and their legal equivalents, rather than by the examples given.

What is claimed is:

1. A pulse tube refrigerator apparatus including:

a pulse tube having a warm end and a cold end;

a reservoir connected in fluid communication with said warm end of said pulse tube;

at least one vortex chamber having an interior wall, said vortex chamber connected between said warm end of said pulse tube and said reservoir; and means for injecting fluid tangentially into said vortex chamber, causing said fluid entering said vortex chamber to circulate around said interior wall of said vortex chamber.

2. The apparatus of claim 1 wherein:

the fluid injecting means is at least one tangential passage in fluid communication with said vortex chamber.

3. The apparatus of claim 1 wherein:

said vortex chamber is the vortex chamber of a vortex diode.

4. The apparatus of claim 1 wherein:

said vortex chamber is the vortex chamber of a double diode.

5. The apparatus of claim 1 wherein:

said vortex chamber is the vortex chamber of a vortex tube.

6. The apparatus of claim 1 wherein:

said vortex chamber is the vortex chamber of a double vortex tube.

7. The apparatus of claim 1 wherein:

the fluid injecting means tangentially injects fluid into said vortex chamber when fluid is flowing from said pulse tube to said reservoir.

8. The apparatus of claim 1 wherein:

the fluid injecting means tangentially injects fluid into said vortex chamber both when fluid is flowing from said pulse tube to said reservoir and when fluid is flowing from said reservoir to said pulse tube.

9. The apparatus of claim 8 wherein:

the fluid injecting means is configured to cause fluid in said vortex chamber to rotate in the same direction when fluid is flowing from said pulse tube to said reservoir and when fluid is flowing from said reservoir to said pulse tube.

10. A pulse tube refrigerator apparatus including:

a pulse tube having a warm end and a cold end;

a reservoir connected in fluid communication with said warm end of said pulse tube;

a first fluidic diode connected between said warm end of said pulse tube and said reservoir, said first fluidic diode being oriented to favor flow from said pulse tube to said reservoir; and a second fluidic diode connected between said warm end of said pulse tube and said reservoir, said second fluidic diode being oriented to favor flow from said reservoir of said pulse tube refrigerator to said pulse tube of said pulse tube refrigerator.

11. In a pulse tube refrigerator apparatus of the type having a reservoir and a pulse tube, the improvement comprising:

a fluidic diode connected between said pulse tube and said reservoir, said fluidic diode being oriented to offer less resistance to flow from said reservoir to said pulse tube than to flow from said pulse tube to said reservoir.

12. A double diode apparatus comprising:

a vortex chamber having opposed first and second axial ends;

a first tangential passage in fluid communication with said vortex chamber, said first tangential passage intersecting said vortex chamber tangentially near said first axial end of said vortex chamber; and a second tangential passage in fluid communication with said vortex chamber, said second tangential passage intersecting said vortex chamber tangentially near said second axial end of said vortex chamber.

13. The apparatus of claim 12 wherein:

said vortex chamber is a cylindrical space having a length and a diameter, said length of said vortex chamber being more than 10 times its said diameter.

14. The apparatus of claim 12 wherein:

said first and second tangential passages are oriented with respect to each other to cause fluid entering said vortex chamber through said first tangential passage to rotate within said vortex chamber in the same direction as fluid entering said vortex chamber through said second tangential passage.

15. The apparatus of claim 12 further including:

an axial center in said first axial end, into which axial center an opening is formed; and a duct connecting said second tangential passage to said opening.

16. The apparatus of claim 15 further including:

means for facilitating fluid flow out of said opening regardless of which direction fluid is flowing in said first and second tangential passages.

17. The apparatus of claim 16 wherein:

said fluid flow facilitating means includes at least one venturi.

18. The apparatus of claim 16 wherein:

said fluid flow facilitating means includes at least one vortex diode.

19. A double vortex tube apparatus including:

a vortex chamber having opposed first and second axial ends, said axial ends having first and second axial centers, respectively;

a first tangential passage intersecting said vortex chamber tangentially adjacent to said first axial end;

a second tangential passage intersecting said vortex chamber tangentially adjacent to said second axial end;

a first opening in said first axial center of said first axial end;

a second opening in said second axial center of said second axial end;

a first duct connecting said first tangential passage to said second opening; and a second duct connecting said second tangential passage to said first opening.

20. The apparatus of claim 19 wherein:

said first and second tangential passages are oriented with respect to each other to cause fluid entering said vortex chamber through said first tangential passage to rotate within said vortex chamber in the same direction as fluid entering said vortex chamber through said second tangential passage.

21. The apparatus of claim 19 wherein:

said vortex chamber is a cylindrical space having a length and a diameter, said length of said vortex chamber being more than 10 times its said diameter.

22. The apparatus of claim 19 further including:

means for facilitating fluid flow out of said first and second openings regardless of which direction fluid is flowing in said first and second tangential passages.

23. The apparatus of claim 22 wherein:

said fluid flow facilitating means includes at least one venturi.

24. The apparatus of claim 22 wherein:

said fluid flow facilitating means includes at least one vortex diode.

* * * * *